US009345308B2

(12) United States Patent
Benshetrit

(10) Patent No.: US 9,345,308 B2
(45) Date of Patent: May 24, 2016

(54) DEVICE FOR COLOR MATCHING A COSMETIC COMPOSITION WITH THE SKIN SHADE OF A PERSON

(71) Applicant: STUDIO DROR, INC., New York, NY (US)

(72) Inventor: Dror Benshetrit, New York, NY (US)

(73) Assignee: Studio Dror, Inc., New York, NY (US)

( * ) Notice: Subject to any disclaimer, the term of this patent is extended or adjusted under 35 U.S.C. 154(b) by 187 days.

(21) Appl. No.: 14/210,336

(22) Filed: Mar. 13, 2014

(65) Prior Publication Data

US 2014/0272813 A1 Sep. 18, 2014

Related U.S. Application Data

(60) Provisional application No. 61/782,239, filed on Mar. 14, 2013.

(51) Int. Cl.
*G09B 19/00* (2006.01)
*A45D 44/00* (2006.01)

(52) U.S. Cl.
CPC ..... *A45D 44/005* (2013.01); *A45D 2044/007* (2013.01)

(58) Field of Classification Search
USPC ..... 434/72, 74, 75, 81, 84, 94, 98–100; 356/402, 421, 422
See application file for complete search history.

(56) References Cited

U.S. PATENT DOCUMENTS 1,612,791 A * 12/1926 Ames ..... G01J 3/52 356/422
1,741,080 A 12/1929 Stenz
1,871,078 A * 8/1932 Nash ..... G01J 3/52 434/98
4,523,852 A * 6/1985 Bauer ..... G01J 3/52 356/243.5
D281,173 S * 10/1985 Bloom ..... D19/37
5,178,169 A * 1/1993 Lamle ..... A45D 44/005 116/200
5,562,109 A * 10/1996 Tobiason ..... A45D 44/005 132/200
6,035,867 A * 3/2000 Barrick ..... A45D 40/0087 132/319
6,112,665 A * 9/2000 Teter ..... B42D 1/00 101/483
6,217,934 B1 * 4/2001 Eilenberger ..... G01N 33/32 264/406
6,598,608 B1 * 7/2003 Downey ..... A45D 40/30 132/200
6,717,673 B1 * 4/2004 Janssen ..... G01J 3/46 356/402
6,734,973 B1 * 5/2004 Mutters ..... A01G 7/00 356/421
6,743,020 B2 * 6/2004 Pestl ..... G09B 11/04 434/100
6,985,230 B2 * 1/2006 De Rigal ..... A45D 44/005 356/421
6,994,553 B2 * 2/2006 DaRif ..... G09F 5/04 434/98
8,144,326 B2 * 3/2012 Batchelor ..... C11D 17/041 206/459.5
8,542,361 B2 * 9/2013 Meijer ..... G01J 3/463 356/421

(Continued)

OTHER PUBLICATIONS

International Searching Authority, Notification of Transmittal of the International Search Report and the Written Opinion of the International Searching Authority, or the Declaration, Jul. 12, 2014, 9 pgs.

*Primary Examiner* — Kurt Fernstrom
(74) *Attorney, Agent, or Firm* — Gottlieb, Rackman & Reisman, PC

(57) ABSTRACT

A device for matching the skin shade of a person with the shade of a cosmetic composition includes a tape having a plurality of transparent and opaque portions. The opaque portions have different shades and unique shapes that are coded to so that each portion can be matched to a cosmetic composition of a particular shape by the shape of the portion. When the tape is attached to or at least placed adjacent to the body portion of a person, the opaque portion having a shade that is close to the shade of the skin of the respective body portion becomes substantially invisible.

9 Claims, 3 Drawing Sheets

(56) References Cited

U.S. PATENT DOCUMENTS 8,646,326 B2 * 2/2014 Peltz ..... B44D 3/003 156/64
2009/0235946 A1 9/2009 Kalla et al.
2010/0303315 A1 12/2010 Rohner et al.
2015/0253191 A1 * 9/2015 Badri ..... G01J 3/52 434/98

* cited by examiner

DEVICE FOR COLOR MATCHING A COSMETIC COMPOSITION WITH THE SKIN SHADE OF A PERSON

RELATED APPLICATIONS

This application claims priority to U.S. Application Ser. No. 61/782,239 filed Mar. 14, 2013 incorporated herein in its entirety.

BACKGROUND OF THE INVENTION

A. Field of Invention

This invention pertains to a shade matching device having a tape with transparent and opaque portions. The opaque portions have different shades of a color and unique shapes coded to match their color so that when the tape is positioned or attached to the person's skin, the cosmetic composition with the shading closest to the skin shade is selected.

B. Description of the Prior Art

Many cosmetic procedures require the application of one or more preparations to the skin of a person, typically in several layers. Some of these preparations (usually the preparation forming the outermost layer) should match accurately the natural color of the skin so that they are not visible. However, since the natural skin color varies not only from one person to another, but in fact, from one portion of person's body or face to another. Therefore this matching is a difficult process and often it is not done accurately even by very experienced makeup artists.

Most cosmetics are sold in boxes with the color of the preparation being printed on the box in a store. If a person is buying a cosmetic substance online, he or she must look at the color of the substance on an electronic screen, and since the colors on electronic screens are not standardized, it is very easy to make a mistake and buy the wrong color. Some stores provide samples that one can apply in the store to determine what is the best matching color for a cosmetic substance. While this procedure may work well on the hand of a person, it is difficult to apply a sample to the face. Moreover, the lighting in a store may affect the way a sample looks on the skin.

Thus there is a need a novel system that allows a person to select a cosmetic substance having the ideal color.

SUMMARY OF THE INVENTION

A device constructed in accordance with this invention includes a flat strip sized and shaped to be attached to or at least placed next to a body portion of a person having a skin shade. The strip has a flexible body with an adhesive applied on one side. The body is transparent except for a plurality of opaque portions, each opaque portion having a specific shade and a unique shape. The shape is used to define a unique indicia identifying the shade of the respective opaque portion and relate that shade to the shade of a cosmetic composition.

The shape may be an alphanumeric character, a geometric or non-geometric shape, etc. However because of the transparent portion, when the tape is attached to said body portion, essentially only the portions having shades that are different from the skin shade are visible.

The device may be in the shape of an elongated rectangular tape or it may be shaped to facilitate its application to a body part.

In one embodiment, the opaque part forms of the unique shape while in another embodiment, the unique shape is transparent and the surrounding portion of the tape is opaque.

In one embodiment, the opaque portions are formed of a plurality of dots that may be circular or may have other shapes.

DESCRIPTION OF THE INVENTION

Figure 1:
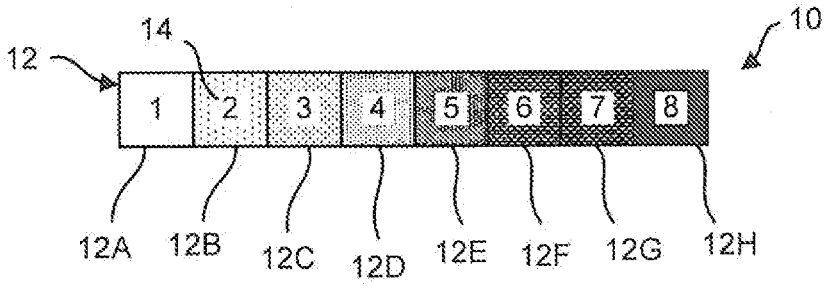
FIG. 1 shows a strip constructed in accordance with this invention.

The device constructed in accordance with this invention includes a strip or tape 10 made of paper, plastic or other similar material, as shown in FIG. 1 and may be provided with an adhesive (not shown) on one side. The strip can have any desired shape and size as discussed in more detail below. The strip 10 is partitioned into several zones 12. In FIG. 1, these zones 12 are generally square however they can have any desired shape. All the zones have preferably the same color but slightly different shades. For example, as seen in FIG. 1, zones 12A, 12B, 12C can be on the left side of the strip and are getting progressively darker toward the right side with zone 12H being the darkest. While it is believed that it is advantageous to arrange the zones change gradually from lighter shades to darker shades from left to right, or vice versa, the strip 10 can also be made so that its zones gradually change shading from the center outward, or in the alternative, if the zones can be arranged randomly, as long as they have different shadings. Of course, for some cosmetic compositions, shading differences may not be so drastic, in which case, some the zones may have a different color than others. For example, zones 12A-12D may be shades of tan while zones 12E-12H could have shades of pink.

Figure 3:
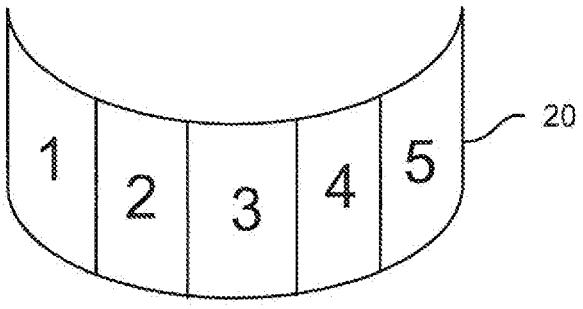
FIG. 3 shows a second embodiment of the invention used for matching the skin below the eye of a person.

Importantly, each zone 12 is provided with a transparent portion 14, each zone having a transparent portion with distinct, easily, recognizable shape. In FIGS. 1-3, transparent zones have shapes of numerals, e.g. 1, 2, 3, 4 etc. The numerals need not be in any order. The transparent portions can be have the shapes of letters, and other arbitrary shapes, including geometric or even free form shapes, as long as they are easily recognizable. In an alternate embodiment, instead of being transparent, the portions may be translucent, or may be formed by openings or cutouts.

The shape of the portions 14 provides a unique indicia identifying the exact shade of the respective zone. Preferably the indicia the correspondence between in the indicia and the respective shade of any zone is provided or selected by the manufacturer of a cosmetic preparation. So for example, a manufacturer prepares a strip 10, such as the one shown in FIG. 1 for cosmetic preparation, the strip having eight different shades of tan. Each zone has a shade that corresponds to the shade of a cosmetic preparation made by the manufacturer, with the zone on the left side being the lightest and the zone on the right being the darkest. Each cosmetic preparation is assigned a product number that is keyed to the indicia of the respective zone of the strip. For example, for the strip of FIG. 1, the manufacturer can assign the product codes T1, T2, T3, T4 . . . for the cosmetic shades having respective shades 1, 2, 3, 4 . . . Of course the product codes can be arbitrary or can be selected in any desired manner as long as there is a known correlation between the product codes and the shade of the respective zones 12 on the strip 10.

As discussed above, the strips 10 can be made from various materials, In one embodiment of the invention, the strips 10 are made of a transparent medical silicone adhesive tape available from the 3M company under product number 2476P. This material is advantageous because it is thin and flexible, can be applied to the skin of the person easily and then removed without causing pain. It is also hypoallergenic and sterile.

The strips 10 are cut from a sheet of this material, and the zones 12 are printed on the strips, preferably in one step with specifically mixed inks. Alternatively, a two-step process is used: first a uniform thin layer of ink or paint is applied to the transparent tape and then each individual zone is applied using an ink having the exact shade of one the respective cosmetic composition for the respective zone.

Once the strips are made, the manufacturer then makes these strips available at retail stores or mails them to the customers.

Figure 2A:
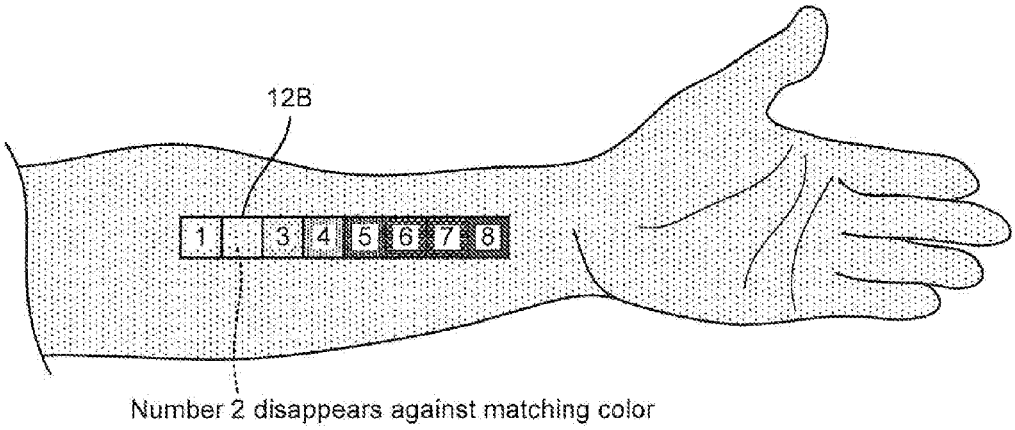
FIGS. 2A-2C illustrate how the strip of FIG. 1 is used to match of the skin on three different persons, respectively.
Figure 2B:
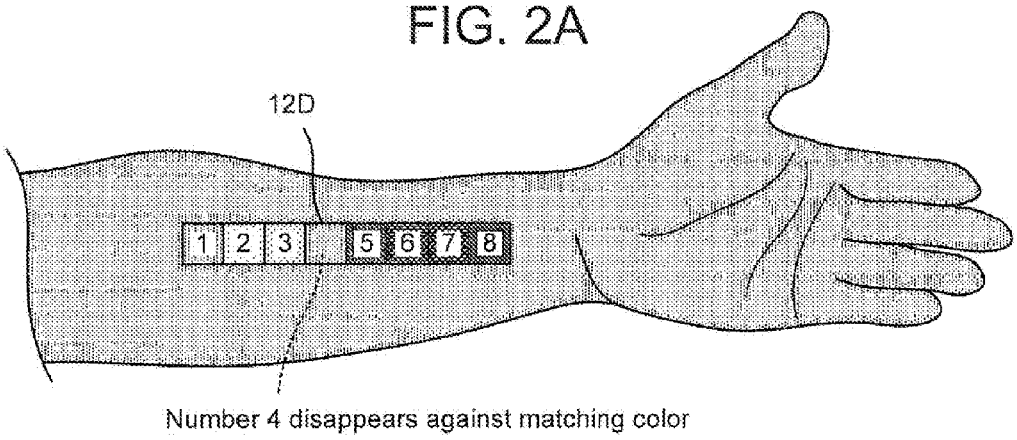
Figure 2C:
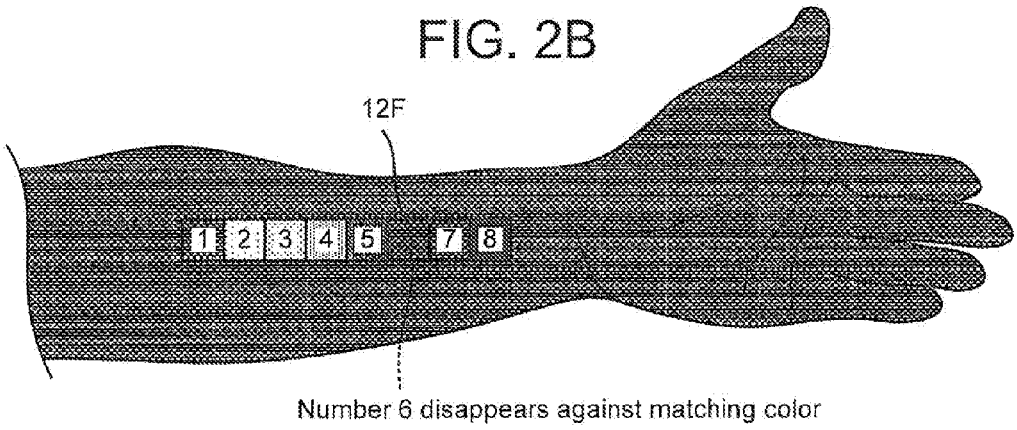

A customer wishing to buy the respective cosmetic composition, first takes the strip and positions it on the appropriate body portion. In FIGS. 2A, 2B, 2C the arms of three different customers have different skin colors are shown together with identical strips 10 applied to the arms. Because each zone 12 has a portion that is transparent, when the strip 10 is placed on the arm of the person, the skin is clearly visible through the transparent portions 14. Importantly, transparent portions 14 are clearly visible for most of the zones. However the transparent portion 14 is almost invisible in the zone (or zones) that has the same or almost the same shade as the shade of the skin of the person. In these zones, the transparent portions of the zones are almost invisible.

More specifically, in FIG. 2A, in zone 12B the transparent portion in the shape of the number 2 disappears indicating that the shade of this zone is very close if not identical to the skin of that particular customer. The customer now knows that he or she must order the cosmetic composition corresponding to indicia 2, or T2.

For the customer in FIG. 2B, the portion in zone 12D having the shape 4 disappears and therefore this customer should buy the cosmetic composition having the shade corresponding to the respective zone, e.g. T4, and the customer in FIG. 2B has to buy the cosmetic composition having the shade of the zone with indicia in the shape of 6, e.g., T6, etc.

It should be noted that even on the same person, the skin on one body portion may be different from the skin on a different body portion and therefore the same (or even a different) strip must be used to determine the correct shade for different body portions. Strips with different shapes and having zones with different shadings may be provided for different parts of the body. For example, FIG. 3 shows a strip 20 having at least two arcuate opposed edges 22, 24. This strip 20 is sized and shaped to fit under or over the eyes of a person so the person can select a cosmetic composition for eye makeup either below or about the eyes.

Figure 4:
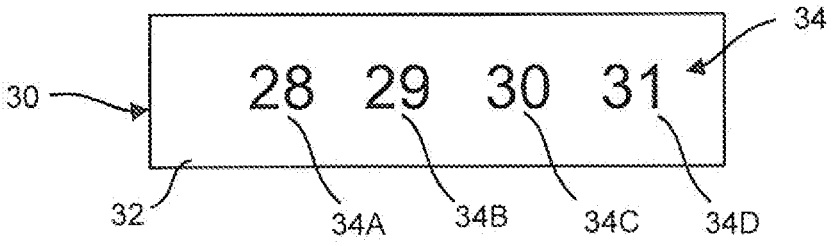
FIG. 4 shows a third embodiment of the invention having a transparent strip with colored indicia.

Of course, strips may have different structures as well. FIG. 4 shows a strip 30 with a uniform transparent segment 32. A plurality of portions 34A, 34B, 34C 34D are provided on segment 32. Again, in one embodiment, these portions are created by first printing each portion 34A-34D in a base opaque color and then each adding a layer of pigmented ink on each portion, said pigmented ink having a respective shade different from the shades of the other portions. As in the embodiment of FIG. 1, the shadings of the portions change gradually from a very light shade for portion 34A to a very dark shade for portion 34D. In the embodiment of FIG. 4, the portions 34A . . . 34D are formed in the shape of two numerals, however, they could be have any other shapes as well. Moreover, the shapes forming the indicia of the portions 12 or 34 could be continuous or solid, or could be formed of a plurality of subelements. For example, in FIG. 4, portions 34 are formed of small dots 36, the dots having a uniform size. The dots could also be circular, square, or other geometric or non-geometric shape.

Figure 5:
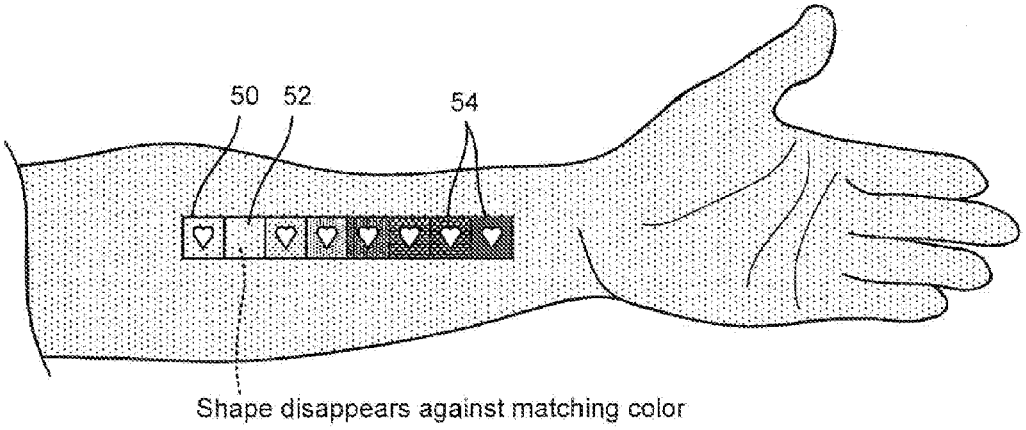
FIG. 5 shows a fourth embodiment in which the indicia in different zones have the same shape.

In the embodiments of FIGS. 1-4 a strip is provided with a plurality of shapes, each shape corresponding to a particular shade of a cosmetic composition. In another embodiment shown in FIG. 5, a strip 50 is provided with a plurality of similar zones 52, each zone having a particular shade and including a transparent portion 54. Importantly, in this embodiment portions 54 have the same shape (e.g., a heart-shape). In this embodiment, the shades of the zones are identified for example from the position of the respective zone on the strip. Thus, the manufacturer of the cosmetic composition will standardize the strips so that the first zone is always shade T1, the second zone is T2, etc. Alternatively, a separate ID code (not shown in FIG. 5) is printed in each zone using standard ink.

Figure 6:
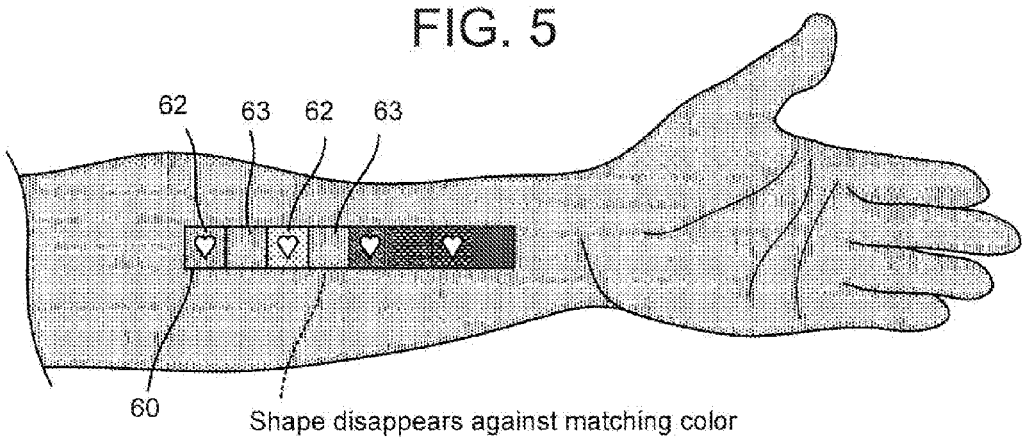
FIG. 6 shows a fifth embodiment in which zones of different colors are used.

In some instances, the skin may have not only different shades but slightly different colors as well. Therefore, in some instances, several zones are provided on a strips that differ in shading as well as color. For example, strip 60 shown in FIG. 6 is formed of zones 62 having a tan color, and zones 63 having a rose color. The zones can be arranged in any sequence. In FIG. 6, zones 62 are interspaced with zones 63.

Figure 7:
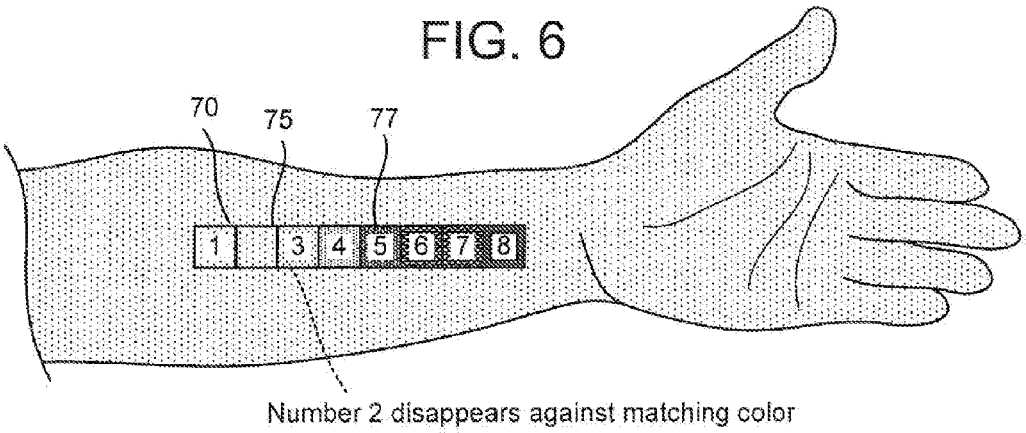
FIG. 7 shows a sixth embodiment in which a strip is provided with a frame.

The material used to make the strips shown in the figures is very thin, and as a result may be hard to handle, especially since preferably it is should be applied to the skin as smoothly as possible, with no folds, twists or distortions. In order to make the strip more manageable, it can be provided with a reinforcing frame made of a somewhat stronger material. For example, FIG. 7 shows a strip 70 having a central area 75 divided into zones as discussed above, and a surrounding reinforcing frame 77.

While the present invention was described in conjunction with cosmetic composition applied to the skin of a person, similar devices may be applicable to other types of cosmetic compositions, including hair color, nail polish, etc.

Moreover, the described concept may be extended to many different fields where color matching is important, or desirable, such as matching the new paint for a wall to an existing paint, matching the color of upholstery, carpets, window treatments in the field of home decorating; matching the colors of dresses, shoes, pocketbooks and other accessories in the field of fashion, matching the color of teeth or crowns in the field of dentistry, etc.

Numerous other modifications may be made to the invention without departing from its scope as defined in the appended claims.

I claim:

1. A color matching device for selecting a cosmetic composition to be applied to a body portion of a person having a specific skin color, comprising:

a tape having a flexible body with an adhesive applied on one side so that the tape can be temporarily be attached to body portion;

said body being transparent except for a plurality of opaque portions, each opaque portion having a specific shade identifying the shade of the respective opaque portion, whereby when the tape is attached to said body portion, essentially only the portions having shades that are different from the skin shade are visible;

wherein said opaque portions are formed of a plurality of dots; and wherein each said opaque portion has a unique shape identifying a respective shade.

2. The color matching device of claim 1 wherein said dots are circular.

3. The color matching device of claim 1 wherein said tape is rectangular.

4. The color matching device of claim 1 wherein said tape has curved sides selected to match a contour of the respective body part.

5. The color matching device of claim 1 wherein said the opaque portion is surrounded by transparent tape.

6. A color matching device for matching the color of a covering element to the color of a target comprising:

a tape formed of a plurality opaque and transparent portions cooperating to define a plurality of shapes, each shape being unique and having a unique shade coded to the unique shape, said unique shape corresponding to the color of the respective covering element, wherein placing the tape against the target renders the opaque portion with shade matching the color of the target substantially invisible.

7. The color matching device of claim 6 wherein each said opaque portions are formed of a plurality of dots.

8. The color matching device of claim 6 wherein some of said opaque portions have a first color and other opaque portions have a second color.

9. The color matching device of claim 6 wherein said the opaque portion is surrounded by transparent tape.

* * * * *